United States Patent [19]

Audouin

[11] Patent Number: 4,900,194

[45] Date of Patent: Feb. 13, 1990

[54] PORTABLE MACHINE AND PROCESS FOR FORMING GROUND STRUCTURES REINFORCED WITH TEXTILE THREADS

[76] Inventor: Michel Audouin, 06, Parc de Bearn, 92210 Saint Cloud, France

[21] Appl. No.: 278,184

[22] Filed: Nov. 30, 1988

[30] Foreign Application Priority Data

May 16, 1988 [FR] France ..... 88 06529

[51] Int. Cl.[4] ..... E02D 3/00; E02D 17/20

[52] U.S. Cl. ..... 405/258; 405/269; 405/303

[58] Field of Search ..... 405/258, 269, 15, 16, 405/17, 284, 286, 303; 404/70, 72

[56] References Cited

U.S. PATENT DOCUMENTS 4,645,381 2/1987 Leflaive et al. ..... 405/258
4,662,946 5/1987 Mercer ..... 405/258 X
4,666,346 5/1987 MacLeod ..... 405/269

FOREIGN PATENT DOCUMENTS 2572435 5/1986 France .
2572449 5/1986 France .

*Primary Examiner*—David H. Corbin
*Attorney, Agent, or Firm*—Thomas R. Morrison

[57] ABSTRACT

The invention relates to the formation of ground areas consisting of a three-dimensional mixture of textile threads and a granular material. According to the invention, the portable machine provided for this purpose comprises a tube provided with a handle and ending in a head equipped with ejectors, each of which has an ejection nozzle fed with threads and receiving a supply of pressurized fluid intended to spray the threads onto the ground area, said ejectors being disposed on a distributor bar on which they are oscillatably mounted. Means may in addition be provided to control the frequency and the oscillation amplitude of the ejectors and also the ejection speed of the threads. The invention is applicable to the construction of reinforced ground structures.

11 Claims, 3 Drawing Sheets

PORTABLE MACHINE AND PROCESS FOR FORMING GROUND STRUCTURES REINFORCED WITH TEXTILE THREADS

The invention relates to a portable machine for spraying textile threads, with the aim of building reinforced ground structures, which consist of a three-dimensional mixture of such threads suitably entangled in the mixture and of a granular material, such as sand, delivered onto the ground area in an accelerated jet with the aid of auxiliary supply means.

The invention also deals with the processing of such ground structures constituted in this manner, using the previously described apparatus.

As described in particular in the European Patent No. 80 400 379 6 filed on the 21st of March 1980, a process for ground structures building consisting in mixing intimately a granular material (sand in particular) with synthetic threads is already known. In addition, tests have shown that such a material was really presenting good strength and cohesion qualities by using for instance a proportion by weight of threads and sand in an order of 1.5 per thousand with threads of 330 decitex (It may be recalled that a thread which has a count equal to one tex has a weight of 1 gram per thousand meters).

On the basis of the Utility Certificate FR 2 572 431 filed on the 26th of Oct. 1984 by the present applicant, a machine allowing to mix intimately a granular material with tangles of textile threads, suitably spreaded and tensioned, is also known.

That was however related to a heavy equipment conceived around a motorized tractor vehicle such as the one used in earth moving. It was equipped with a directable jib enabling work to be done from a distance over vast sites for example against a wide slope or a cliff.

It has however been found that, because of their sizes, somes sites did not require the use of such units.

In practice it has even been found that what was taken as an advantage for some sites (work from a distance, high delivery rate of deposited material) could be a drawback or become unsuitable, particularly if the site is difficult to approach because of the lack of access, unfavourable natural conditions . . . etc . . . or in case of less extensive or even very small working areas.

In order to meet this need and to enable the operator in charge of the machine to control the quality of the material which he has to deposit, while providing him with adequate working conditions, the invention proposes a portable machine which is characterized in that it comprises a tube provided with a handle and ending in a head equipped with ejectors. Each ejector possesses an ejection nozzle fed with threads and receiving a supply of pressurized fluid intended to spray the threads out of the nozzles on the treated area. Those ejectors are positionned on at least one distributor bar on which they can oscillate.

The oscillation movements of the ejectors will preferably be synchronized by a system of links connecting the ejectors to one another. These links, which may be adjustable in length, will regulate the oscillation amplitude of the ejectors.

According to another characteristic of the invention, it is also envisaged to equip the machine to monitor the frequency and/or the amplitude of the ejectors oscillation.

It will also be mentioned that the pipe supplying the pressurized fluid to the thread ejection nozzles may be provided with a valve regulating the flow of fluid and enabling the ejection speed of the threads to be regulated.

In this way it will be possible to achieve controlled deposition of the threads on the ground under the best operating conditions, by simple twinned regulation of the ejection speed of the threads, of the amplitude and of the oscillations frequency of the ejectors.

With regard to the process of reinforced ground structure construction in accordance with the invention, using a machine of the abovementioned type, it will be noted that this process is characterized in that while delivering a given quantity of granular material onto a ground zone of determined width which has to be reinforced, a reciprocating oscillatory movement is given to the ejectors to sweep over the entire required width of ground with an adjustment such that the jets of threads are superposed in pairs.

Thus it is possible to achieve a suitable cohesion between the granular material and the threads whatever are, practically, the nature of the ground which has to be consolidated or to be formed.

The invention and the manner in which it is put into practice will emerge more clearly from the following description, which is given with reference to the drawings joined in an annexe, in which.

Figure 1:
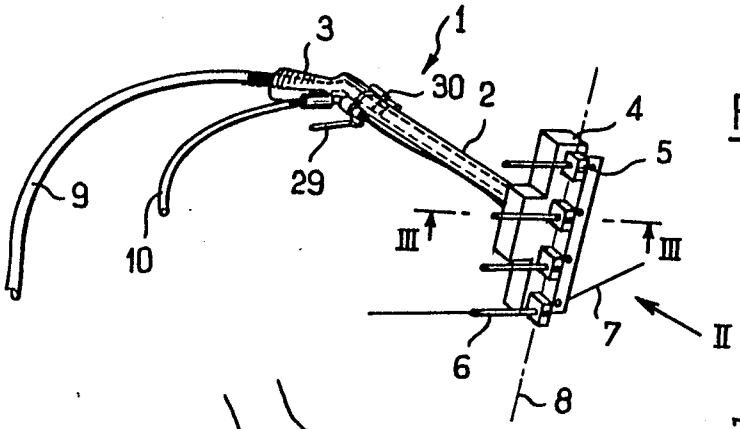
FIG. 1 is a schematic general view of the machine of the invention, illustrating clearly its "gun-like" shape

A description of the invention will be given firstly in reference of FIG. 1 where the portable machine 1 of the invention is illustrated, presented in the general form of a gun provided with an almost rectilinear tube or barrel 2 and with a handle or grip 3 allowing the operator to held the machine.

The tube 2 connects the handle 3 to a head 4 equipped with ejectors 5, each one carrying an ejection nozzle 6 fed with textile threads 7 and intended to spray the threads, through the pressure of a fluid (preferably a liquid) such as a jet of water, onto the treated area.

As illustrated, the ejectors 5 are positioned on the head 4 along a distributor row with a general axis 8 directed substantially at right angle to the tube 2 and on which the ejectors 5 can oscillate.

These ejectors are fed with the fluid under suitable pressure by a supply hose 9 connected upstream to a pipe (not shown).

It will be also mentioned that the gum is in addition provided with another flexible hose 10 for the compressed air supply. The purpose of the latter will be cleared later on.

Figure 2:
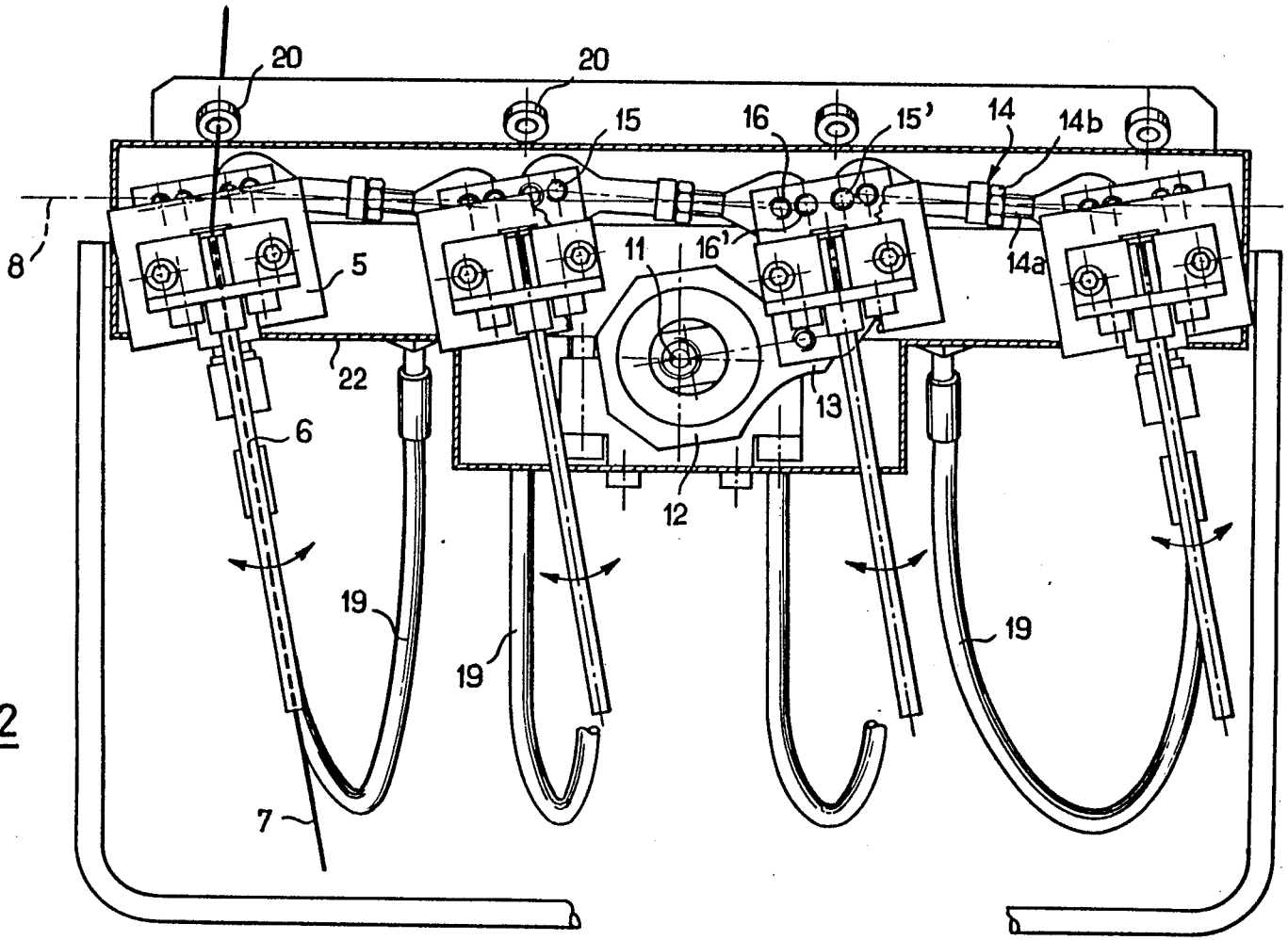
FIG. 2 is a front view of the ejection head of the machine, viewed in the arrow II direction shown in FIG. 1
Figure 3:
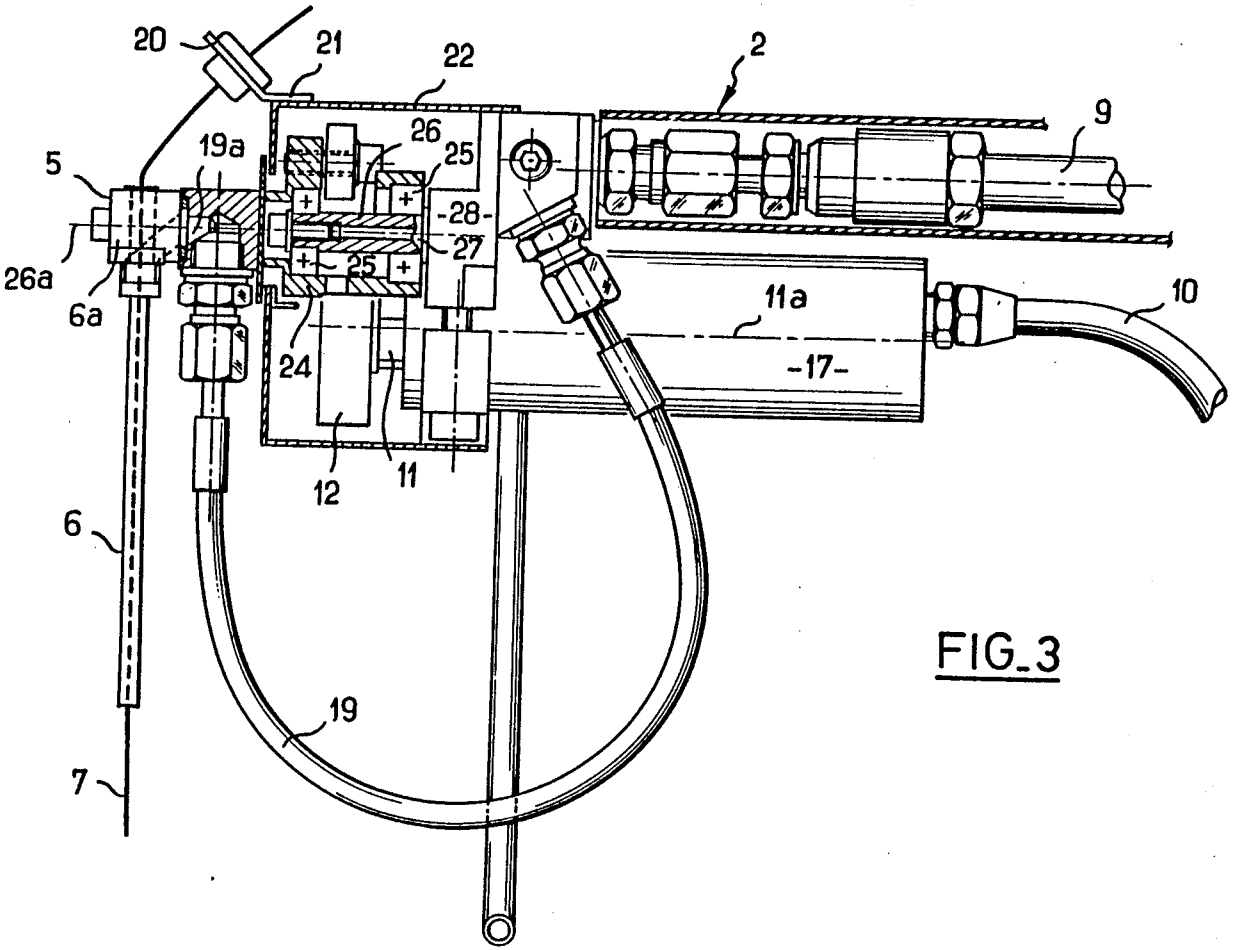
FIG. 3 is a section view from the head made on the line III—III shown in FIG. 1

Referring now to the FIGS. 2 and 3, which illustrate in detail the machine head in the region of its ejectors, it will be observed that the reciprocating oscillatory movement of the latter is achieved by an eccentric 11 whose axis is substantially at right angles with the one from the axis 8 and which is mounted in a casing 12 engaged by a finger 13 on the body of one of the ejectors. A series of track links 14, which are preferably adjustable in length, connects together each two consecutive ejectors, for giving them a conjugate or synchronous oscillation movement.

15 and 16 designate the attachment points of the links 14 to the four ejectors (FIG. 2). But other attachment points, such as 15',16', could also be provided in order to increase the range of adjustment of the oscillation amplitude from each ejector.

Reference will now more particularly be made to FIG. 3, to point out that the eccentric 11 is driven rotationally about its axis 11*a* by a shaft (not shown) driven by a rotary engine (see 17), which is fed with compressed air through the hose 10 described previously. Through the engine action, the eccentric 11 which is free to rotate in its casing 12, drives the latter in a reciprocating rectilinear movement. Thanks to the finger 13 the movement is given to one of the ejection heads by an intermediate member 24 mounted on bearings 25, the inner ring of which (not shown) receives a shaft 26 rigidly connected at 27 to a fixed member 28 which is rigidly connected to the tube 2. The oscillatory movement of the ejectors will thus be made about the axis 26*a* of the shaft 26, which is directed substantially parallel to the tube 2.

In FIG. 3 it can also be seen that the flexible hose 9 supplying pressurized fluid (water) to the nozzles 6 is divided at the ejection head of the machine into a series of flexible tubes 19 (see also FIG. 2), each of which leads, through an aperture 19*a*, to the admission end 6*a* of one of the nozzles, which is also the admission point for a thread 7 after the latter has been guided through a ceramic-walled eyelet 20 mounted on a support plate 21, which is fixed itself on a casing 22 protecting the control members of the ejectors.

Attention will now be drawn to the control means of the machine, since in practice it has been found useful to be able to regulate, preferably in a combined manner, the oscillation amplitude and the stroke frequency of the ejectors, so as to be able to carry out fine adjustment of the distribution of the threads on the ground.

With regard to the oscillation amplitude, use is made of a regulation system comprising a screw 14*a* and a nut 14*b* mounted on each link. With regard to the stroke frequency, provision has been made to control this with the aid of a regulation means, such as a valve 29 mounted near the grip 3 and making it possible to regulate the flow of compressed air through the hose 10, and therefore on the rotation speed of the rotary engine 17.

There remains the problem of the metering of the threads and the granular material.

Since the hose 9, feeding the ejectors 5 with pressurized fluid (water), passes through the gun from the base of its grip to the end of its tube 2, this problem has been solved by providing, near the grip 3 of the gun, a metering valve 30 allowing the control of the flow of water and consequently of the ejection speed of the threads.

From the above description it is clear that the described machine permits a very flexible use. Its easy operation allows very accurate targeting of the concerned ground area, and the width 1 of this area can, as illustrated in FIG. 4, be adapted to working conditions by appropriate regulation of the links 14 which, as it will have been understood, determine the amplitude of oscillation of the ejectors.

Figure 4:
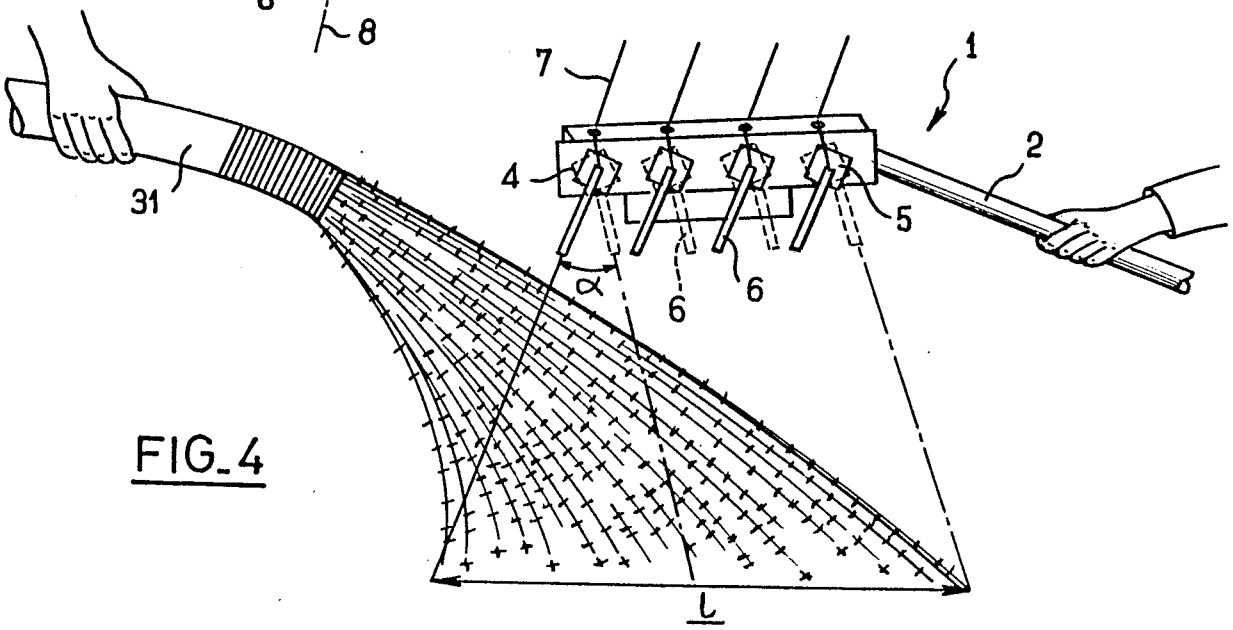
FIG. 4 shows schematically how the ejectors are oscillating and how the simultaneous deposition of the threads and of the granular material is done.

In FIG. 4 the stroke angle of one of the ejectors is designated $\alpha$

In practice, a good coverage of the ground with a correct interlacing of the threads and the sand has been obtained by adjusting the links so that the jets of threads coming from two contiguous nozzles 6 are superposed in pairs. During the work, the frequency of oscillation of the ejection heads had been adjusted (by action on the valve 29) so that the threads ejected into the mass of sand are tensioned and not loose.

With regard to the delivery of threads, this had been adjusted (by action on the valve 30) so that a ratio of threads to sand included between about 1 and 2 per thousand parts by weight, is obtained.

In FIG. 4 it will be noted that the end portion delivering granular material is also shown at 31, this material being ejected in controlled amounts from a flexible hose of large diameter, connected to an air compressor (not shown), which could optionally also be used to supply compressed air to the rotary engine 17 of the machine.

Thus, by moving along the concerned ground structure, the operator holding the machine of the invention and the manipulator of the sand delivery hose, which will distribute the sand over the width of ground 1, will be able to treat the entire desired working width and to control at all times the thickness or height of ground formed.

The invention is obviously not restricted strictly to the single embodiment described above.

In particular, it would have been possible to provide a different installation of the ejectors, for example disposing them on a distributor row directed parallel to the tube of the machine. It would then have been possible to impart to the ejectors a reciprocating oscillatory movement in a plane substantially parallel to the tube.

It would have been possible also to propose the distribution of the ejectors over several rows.

I claim:

1. Portable machine intended for spraying textile threads, in particular for constructing reinforced ground areas consisting of a three-dimensional mixture of such threads suitably entangled in the mixture and of a granular material delivered onto the area of ground in an accelerated jet with the aid of separate supply means, said machine being characterized in that it comprises a tube provided with a handle and ending in a head equipped with ejectors each of which has an ejection nozzle fed with threads and receiving a supply of pressurized fluid intended to spray the threads out of the nozzles towards the area of ground being formed, said ejectors being disposed on at least one distributor row with oscillating mounting.

2. Machine according to claim 1, characterized in that the reciprocating oscillatory movements of the different ejectors are synchronized by means of a set of links 14 connecting the ejectors to one another.

3. Machine according to claim 2, characterized in that the coordinated oscillatory movement of the ejectors is obtained using an eccentric acting on one of the said ejectors.

4. Machine according to claim 1, characterised in that it is provided with means for varying the frequency of oscillation of the ejectors.

5. Machine according to claim 4, characterized in that the eccentric is driven by a rotary motor fed with air under pressure by a supply hose which is provided with a valve regulating the air flow and enabling the frequency of oscillation of the ejectors to be controlled.

6. Machine according to claim 1, characterized in that the hose supplying pressurized fluid to the nozzles of the ejectors is provided with a valve regulating the flow of fluid and enabling the speed of ejection of the textile threads to be controlled.

7. Machine according to claim 1, characterized in that it includes means for regulating the amplitude of oscillation of the ejectors.

8. Machine according to claim 7, wherein:

said oscillating mounting includes links connecting at least some of said nozzles together for synchronized oscillatory movement;

said links including means for permitting adjustment in length; and said means for permitting adjustment constitute means regulating the amplitude of oscillation of the ejectors.

9. Machine according to claim 2, characterized in that the ejectors are each provided with different attachment points for the links.

10. Portable machine of claim 1, wherein:

said ejectors are disposed at an other end of said pipe opposite to an end having said handle;

said distributor row is oriented substantially perpendicular to said pipe;

said ejectors are oscillatory mounted on said head around an axis substantially parallel to said pipe;

said machine further comprises a pressurized fluid supply means for supplying said pressurized fluid; and said pressurized fluid supply means communicating with said ejection nozzle for spraying said threads towards said area of ground.

11. Process for the construction of reinforced ground structure consisting of a three-dimensional mixture of a granular mixture and of textile threads by means of a machine comprising ejector means for ejecting from the machine the textile threads and supply means for delivering onto the area of ground the granular material in an accelerated jet, characterized in that while delivering a defined quantity of granular material onto a zone of ground of determined width which it is desired to reinforce, a reciprocating oscillatory movement is imparted to the ejectors in such a manner as to sweep over the entire required width of ground with an adjustment such that the jets of threads are superposed in pairs.

* * * * *